US010201252B2

(12) United States Patent
Royal

(10) Patent No.: US 10,201,252 B2
(45) **Date of Patent: *Feb. 12, 2019**

(54) EXPANDING CURTAIN

(71) Applicant: Michael P. Royal, Dallas, TX (US)

(72) Inventor: Michael P. Royal, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/800,822

(22) Filed: Nov. 1, 2017

(65) Prior Publication Data

US 2018/0049599 A1 Feb. 22, 2018

Related U.S. Application Data

(63) Continuation of application No. 15/445,239, filed on Feb. 28, 2017, which is a continuation of application No. 14/829,364, filed on Aug. 18, 2015, now Pat. No. 9,603,491.

(60) Provisional application No. 62/038,540, filed on Aug. 18, 2014.

(51) Int. Cl.
*A47K 3/00* (2006.01)
*A47K 3/38* (2006.01)

(52) U.S. Cl.
CPC . *A47K 3/38* (2013.01); *A47K 3/00* (2013.01)

(58) Field of Classification Search
CPC ..... A47K 3/38
See application file for complete search history.

(56) References Cited

U.S. PATENT DOCUMENTS

| | | | |
|---|---|---|---|
| 2,812,023 | A | 11/1957 | Laity, Sr. et al. |
| 3,293,664 | A | 12/1966 | Coons |
| 3,463,174 | A | 8/1969 | Heller |
| 5,103,531 | A | 4/1992 | Perrotta |
| 5,771,504 | A | 6/1998 | Steiner |
| 5,790,992 | A | 8/1998 | Ray |
| 7,987,534 | B2 | 8/2011 | Lin |
| 8,122,531 | B2 | 2/2012 | Li |
| 9,027,177 | B2 | 5/2015 | Perez |
| 9,603,491 | B2 | 3/2017 | Royal |
| 2006/0000499 | A1 | 1/2006 | Livacich et al. |
| 2009/0071613 | A1 | 3/2009 | Galbiati |
| 2013/0031718 | A1 | 2/2013 | Kelly |
| 2013/0340159 | A1 | 12/2013 | Barrett |

*Primary Examiner* — Lori Baker
(74) *Attorney, Agent, or Firm* — Kirby Drake

(57) ABSTRACT

An expanding curtain may be provided that does not require the addition or installation of a new curved rod and/or any external mechanical devices such as curtain supports, control devices, or adapters to expand the usable space in the enclosure area. Rather, the curtain itself may have the strength, rigidity and/or fortitude to form an outwardly extended shape (e.g., away from the enclosure area) that may hold it in place, thus, expanding the amount of space available for utilization by the user of the enclosure area. The curtain easily and rapidly mounts and thereafter may be easily slidable/manipulated between an open and closed position. The curtain may surround, divide and/or provide privacy to a specific area and/or confined space. The curtain may also maintain a mold, mildew and germ resistant facade, while remaining inexpensive to manufacture.

20 Claims, 10 Drawing Sheets

EXPANDING CURTAIN

CROSS-REFERENCE TO RELATED APPLICATIONS

This Application is a continuation of U.S. patent application Ser. No. 15/445,239 filed on Feb. 28, 2017, entitled "Expanding Curtain," which is a continuation of U.S. patent application Ser. No. 14/829,364 filed on Aug. 18, 2015, entitled "Expanding Curtain," which claims the benefit under 35 U.S.C. § 119(e) of U.S. Provisional Patent Application Ser. No. 62/038,540 filed on Aug. 18, 2014, entitled "Expanding Curtain," all of which are incorporated by reference in their entirety.

FIELD OF THE DISCLOSURE

The present disclosure generally relates to curtains and liners, and more particularly, shower and bathtub waterproof curtains and liners.

BACKGROUND

Shower curtains are often used in combination with a waterproof liner wherein the curtain is maintained outside of the shower or bathtub and the liner is disposed inside, i.e., to act as a barrier for shower water. In some instances, the curtain itself is waterproof and is used as a liner or, optionally, as a decorative curtain and liner in one.

A typical bathtub, which often doubles as a shower stall, is approximately twenty-seven (27) inches wide. As such, even under ideal conditions, there may not be enough space for a user to move about without touching the side solid wall and the shower curtain (such as in the bathtub/shower depicted in FIG. 5), especially if the user has a large frame or has a disability. Further, it is generally recognized that a shower curtain that forms a portion of a shower or bathtub enclosure tends to be drawn inwardly, i.e., into the shower space, during shower use; thereby, providing even less space for a user (such as in the bathtub/shower depicted in FIG. 6). Other problems with conventional shower curtains include the clinging of the curtain to the body of the user, which could be significant in certain circumstances, as shower curtains are typically susceptible to the germs, mold and mildew created in the damp shower environment (especially in motels, hotels, hospitals, etc.).

A number of external shower curtain supports, control devices and adapters have been devised which typically provide supporting frames or arms mounted to a shower rod to prevent a shower curtain's inward draw and/or increase the space that a user may have within a shower area. Some devices involve tying the shower curtain to an outside object, which can be a cumbersome process and/or inhibit the ability of the curtain to be freely opened and closed. Other devices may involve altering the construction of the shower curtain rod itself. However, it may be desirable to remove the expanding device when the shower is not in use, especially in small washrooms. Still other devices have been provided that may be removed when not in use, however, these devices are often bulky and may occupy a substantial amount of space in the washroom even when they are not being used. Curved shower rods have been used to obtain increased space in a shower enclosure. However, such curved rods can be time consuming and/or difficult to install. Curved rods also continue to protrude in to the adjoining washroom area, even when not in use, which can be a significant detriment in small washrooms.

SUMMARY

Embodiments of the present disclosure may provide an expanding curtain to surround, divide and/or provide privacy to a designated area, the expanding curtain comprising: a flat curtain formed of at least one sheet of material and having an expandable center portion, wherein the flat curtain and/or the center portion may be comprised of at least one single panel, and wherein the center portion may be configured to be manually manipulated in an outward direction to expand the amount of usable space in a designated area without the use of a mechanical device. The at least one sheet of material may be selected from the group comprising: a flexible material, a semi-flexible material, a semi-rigid material, a rigid material, and combinations thereof. The at least one sheet of material may be selected from the group comprising: polyester, nylon, plastic, vinyl, silica, plastic-covered cloth, fabric, canvas, cotton, linen, ethylene-vinyl acetate (EVA), polyethylene-vinyl-acetate (PEVA), synthetic material, waterproof synthetic material, natural material, waterproof natural material, and combinations thereof. The plurality of panels may be integrally formed, not integrally formed, or partially integrally formed from the at least one sheet of material. The at least one sheet of material forming the center portion may be the same material as the remainder of the flat curtain. The at least one sheet of material forming all or a distinct part of the center portion may be a different material from the remainder of the flat curtain. The expanding curtain also may include a plurality of holes in a top section of the expanding curtain, the plurality of holes used to mount the expanding curtain on a curtain rod, wherein the expanding curtain may slide along the curtain rod and compress into an accordion-like shape to allow entry and exit from the designated area. The at least one sheet of material may be waterproof. The center portion may be waterproof. The designated area may be a bathtub, and the width of the expanding curtain may at least correspond to the length of the bathtub. The expanding curtain also may include at least one horizontal hinge joint to divide the flat curtain and/or the center portion into the plurality of panels, wherein the plurality of panels may be formed or connected in a specific shape so as to angle in an outward position relative to a user occupying the designated area. The at least one horizontal hinge joint may be selected from the group comprising: a straight line crease, a fold line, a joint where two panels are joined together, and combinations thereof. The expanding curtain may further include at least one vertical hinge joint to divide the flat curtain and/or the center portion into the plurality of panels, wherein the plurality of panels may be formed or connected in a specific shape so as to angle in an outward position relative to a user occupying the designated area. The at least one vertical hinge joint may be selected from the group comprising: a straight line crease, a fold line, a joint where two panels are joined together, and combinations thereof. The expanding curtain may further include at least one diagonal hinge joint to divide the flat curtain and/or the center portion into the plurality of panels, wherein the plurality of panels may be formed or connected in a specific shape so as to angle in an outward position relative to a user occupying the designated area. The at least one diagonal hinge joint may be selected from the group comprising: a straight line crease, a fold line, a joint where two panels are joined together, and combinations thereof. The designated area may be a shower stall. The designated area also may be an examination or work area. The flat curtain and/or the center portion may include a plurality of panels formed or connected by joining two or more panels using one or more bonding techniques selected from the group comprising: adhesive, heat, pressure, welding, and stitching.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Various embodiments of the present disclosure are described more fully hereinafter with reference to the accompanying drawings, in which some, but not all embodiments of the present disclosure are shown in the figures. Indeed, what is described herein may be embodied in many different forms and should not be construed as limited to the embodiments set forth herein.

There exists a need for a curtain that may effectively reduce and/or eliminate the inward intrusion of a curtain, such as during shower use, as well as a curtain's attendant propensity to touch and/or cling to the user. There also exists a need to increase the usable space within an area, such as a shower. There further exists a need for a curtain to avoid taking up valuable space, such as in a washroom, when the curtain is not in use, while still remaining simple to open and close as well as relatively inexpensive to manufacture.

Embodiments of the present disclosure may provide a new and unique curtain that may provide a number of important advantages. The new and unique curtain described herein does not require the addition or installation of a new curved shower rod and/or any external mechanical devices, such as shower curtain supports, control devices, adapters, etc. to achieve its primary aims (i.e., to expand the useable space in the shower enclosure area and/or prevent the inward intrusion of the shower curtain towards the user). Rather, the new and unique curtain according to embodiments of the present disclosure may be designed and manufactured with a material so that the curtain itself will have the strength, rigidity and/or fortitude to form an outwardly extended shape (e.g., away from a designated area, such as a shower and/or bathtub area) that may hold it in place, thus, expanding the amount of space available for utilization by the user of the designated area. The new and unique curtain may be easily and rapidly mounted—e.g., on any standard, straight curtain rod—existing or new (in any manner utilized to mount a standard curtain) and thereafter be easily slidable/manipulated between an open and closed position. A curtain according to embodiments of the present disclosure may be utilized to surround, divide and/or provide privacy to a specific area and/or confined space, including but not limited to, showers, bathtubs, hospital beds, hospital examination rooms, changing rooms, work spaces, etc. The new and unique curtain may also take advantage of technology, materials and design advantages in order to maintain a mold, mildew and germ resistant facade, while remaining inexpensive to manufacture.

Embodiments of the present disclosure may be applicable to curtains, liners and/or drapes, and it should be appreciated that the word "curtain," as used herein, may denote curtains, drapes and/or liners (separately, as well as jointly) without departing from the present disclosure.

Figure 1:
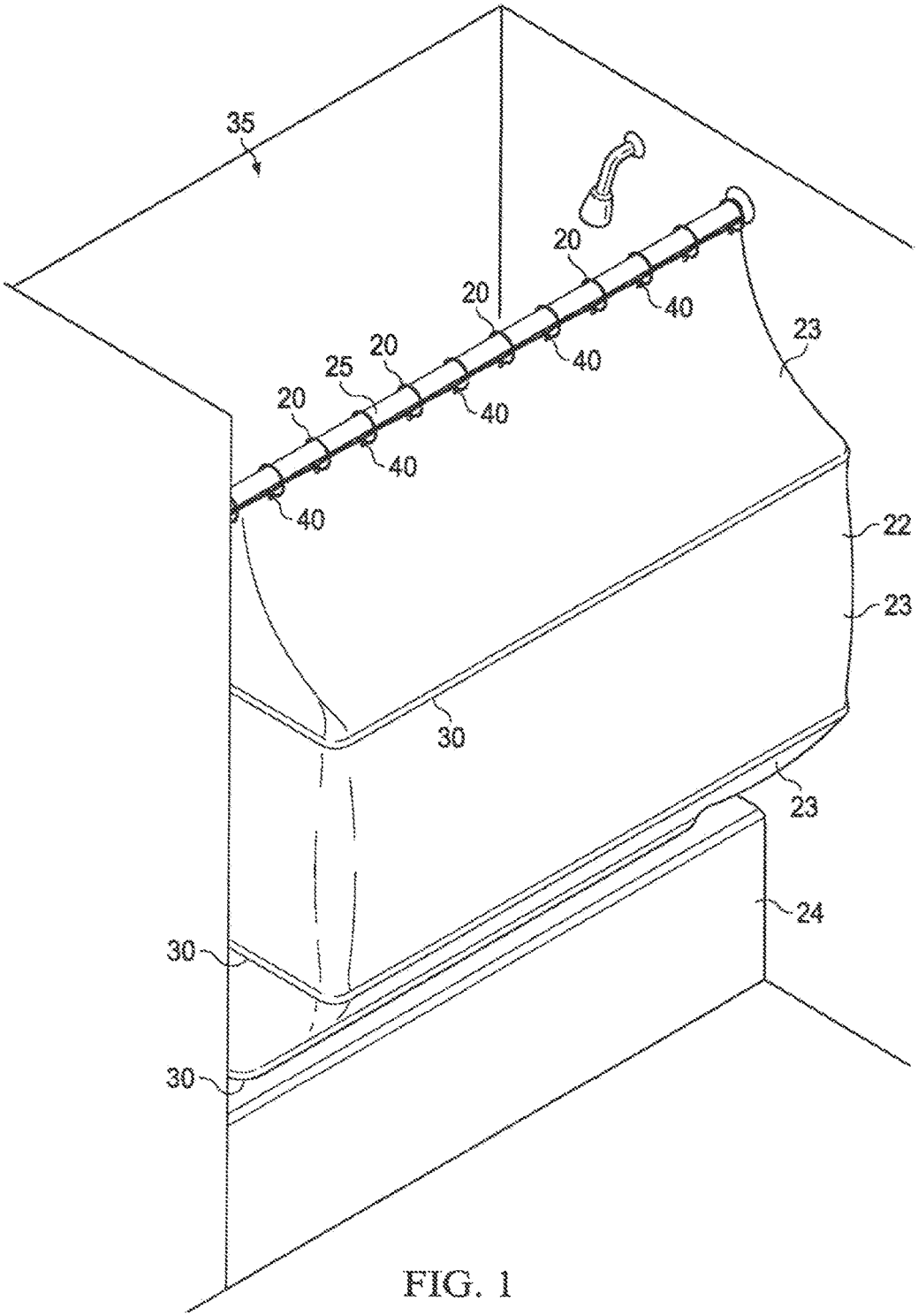
FIG. 1 depicts a perspective view of an expanding curtain according to an embodiment of the present disclosure.

FIG. 1 depicts a perspective view of an expanding curtain according to an embodiment of the present disclosure. As shown, FIG. 1 illustrates a perspective view of curtain 22. Curtain 22 is depicted in standard 3-wall bathtub 24/shower enclosure 35 exemplar; however, it should be appreciated that curtain 22 may be utilized in other situations without departing from the present disclosure. Curtain 22 is depicted as being mounted on straight shower rod 25 utilizing a plurality of standard shower curtain rings 20; however, other means for attaching curtain 22 to shower rod 25 may be employed without departing from the present disclosure.

Curtain 22 is shown in FIG. 1 with three (3) integrated, horizontal hinge/pivot joints 30. These integrated, horizontal hinge/pivot joints 30 may encourage curtain 22 to form and hold a similar desired shape/form each time curtain 22 is utilized. Stated alternatively, the type, thickness, and/or characteristics of the material of which curtain 22 is manufactured, combined with the design of curtain 22, shall provide sufficient strength, rigidity and/or fortitude to curtain 22 to allow it to be manually manipulated (i.e., by hand) in such a manner as to limit or prevent the intrusion of curtain 22 into a designated area, such as a shower enclosure, and significantly increase the amount of usable space within the designated area. Moreover, curtain 22 may accomplish such results without the necessity of any external mechanical devices, such as shower curtain supports, control devices, adapters, etc. or even a curved shower rod. While 3 integrated, horizontal hinge/pivot joints 30 are depicted in FIG. 1, it should be appreciated that there may be embodiments where more or fewer joints may be employed without departing from the present disclosure.

In this embodiment depicted in FIG. 1, curtain 22 may provide additional space to the user inside the bathtub shower enclosure (e.g., especially in the area that typically would correspond to a user's shoulders, torso and hips). Curtain 22 may be used, in part, to prevent water from splashing out of bathtub shower area 24 during use of the shower. In such a manner, it is often desirable for curtain 22 to at least span substantially the entire length of bathtub shower area 24. In the embodiment depicted in FIG. 1, curtain 22 width corresponds closely to the length of bathtub shower area 24. However, in other embodiments of the present disclosure, the width of curtain 22 may be longer, shorter, or equal to the length of bathtub shower area 24. Additionally or alternatively, curtain 22 may have a width and/or height that is sufficient to maintain a desired length of curtain 22 inside the lip of bathtub shower area 24, i.e., for containing the water within bathtub shower area 24. Curtain 22 also may be produced in sizes appropriate for use in a single, free standing shower stall.

Curtain 22 could also be used in a variety of embodiments involving non-shower applications, i.e., any area that requires a curtain and/or drape-type divider to surround, divide and/or provide privacy to a specific area and/or confined space, for example, around hospital beds, hospital examination rooms, changing rooms, work spaces, etc. Curtain 22 also may be manufactured with a mold, mildew and/or germ resistant facade according to embodiments of the present disclosure.

The embodiment of curtain 22, as illustrated in FIG. 1, depicts curtain 22 as being made from one or more sheets of flexible, semi-flexible, semi-rigid and/or rigid material. Curtain 22 may be generally rectangular in shape; however, curtain 22 may assume other shapes without departing from the present disclosure. Curtain 22 may be constructed from one or more materials including, but not limited to, polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof without departing from the present disclosure. It should be appreciated that the thickness of the material may differ depending on the material(s) used to form curtain 22 according to embodiments of the present disclosure. For example, if curtain 22 is formed from vinyl, the thickness may range from approximately 6 gauge to approximately 14 gauge.

Curtain 22 is depicted in FIG. 1 as having a series of holes 40 in the top section in order to provide for one manner of mounting curtain 22 (i.e., on a straight shower rod utilizing a plurality of standard shower curtain rings). In other embodiments of the present disclosure, curtain 22 could be altered to be capable of being mounted in a shower enclosure in any other manner in which curtains or liners are typically mounted in such circumstances.

Curtain 22 in FIG. 1 is shown with three (3) integrated, horizontal hinge/pivot joints 30, which divide curtain 22 into multiple panels 23. Hinge/pivot joints 30 could be formed through various methods including, but not limited to, stitching, use of adhesives, welding, and/or the application of pressure and/or heat along horizontal hinge/pivot joint 30 (i.e., to form a "creased" effect), increasing the thickness of the material in such area, inserting a different material in such area, and/or any other method by which the desired result is obtained. It should be appreciated that more or fewer hinge/pivot joints 30 may be utilized without departing from the present disclosure.

Alternatively, multiple panels 23 that comprise curtain 22 could be manufactured separately of one or more types of flexible, semi-flexible, rigid, and/or semi-rigid material (including, but not limited to, polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof) and joined together by welding, adhesive, stitching, use of heat or pressure, or similar connection method (thereby forming hinge/pivot joint 30). To the extent included, flexible, horizontal hinge/pivot joints 30 may allow the integrated (or discrete) multiple panels 23 of curtain 22 to generally form and hold various shapes, sizes and/or dimensions, by each maintaining multiple panels 23 in a desired angled outward position when the designated area, such as a shower area, is in use/occupied by a user. In other embodiments, curtain 22 could be comprised of one or more panels that are opaque or translucent, and/or potentially combined with one or more panels that are solid, colored, patterned, of a different texture, etc.

Figure 2:
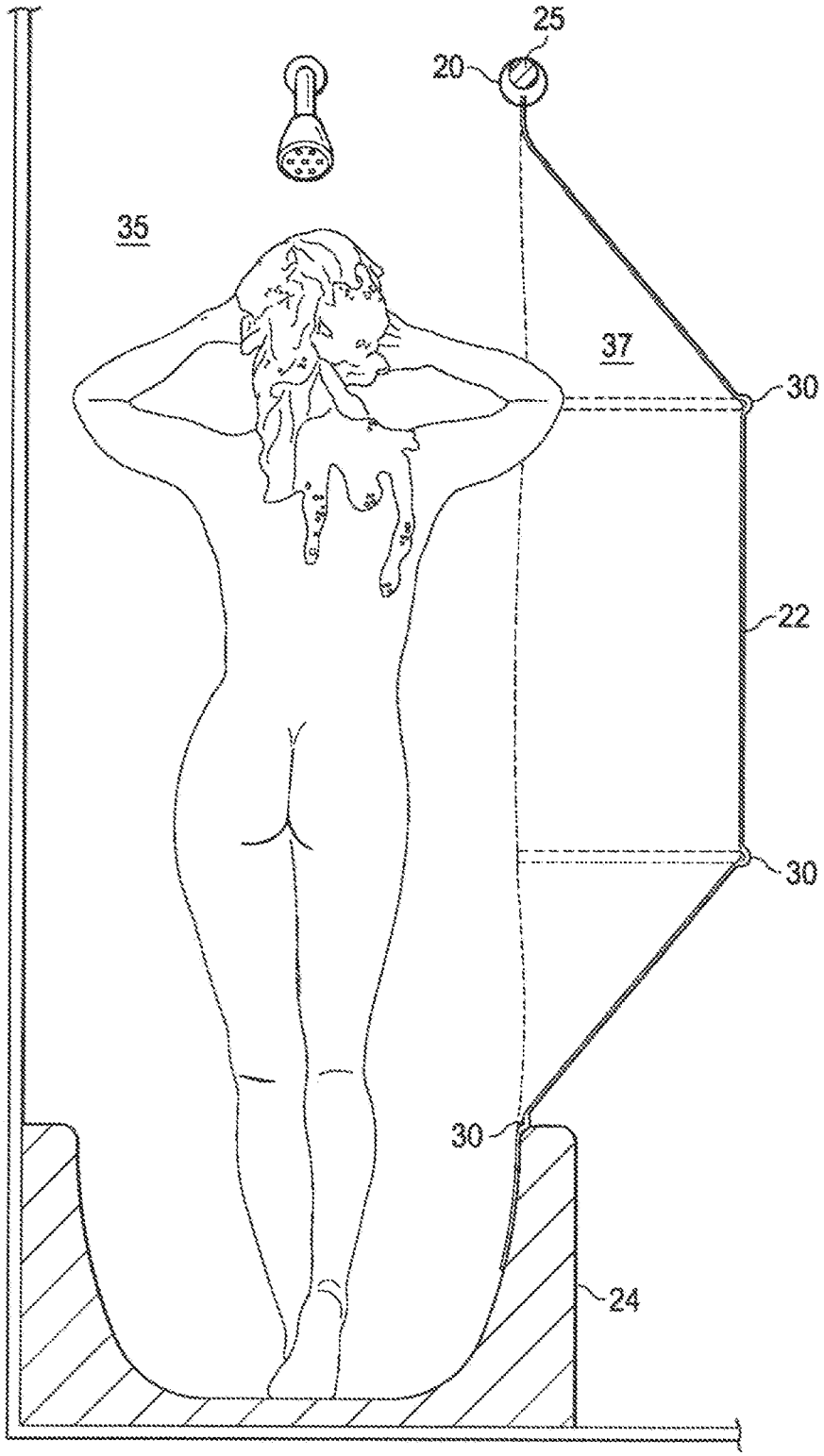
FIG. 2 depicts a side view of an expanding curtain according to an embodiment of the present disclosure.

FIG. 2 depicts a side view of the expanding curtain according to an embodiment of the present disclosure. Curtain 22 is shown in standard bathtub 24/shower enclosure 35 exemplar; although, it should be appreciated that curtain 22 may be utilized in other situations without departing from the present disclosure. Curtain 22 is depicted as being mounted on a straight shower rod 25 utilizing a plurality of standard shower curtain rings 20. Curtain 22 is shown in FIG. 2 with three (3) integrated, horizontal hinge/pivot joints 30. However, another embodiment of curtain 22 might have more or fewer horizontal hinge/pivot joints 30 or it might not have any defined, integrated, horizontal hinge/pivot joints 30 at all depending on space requirements and configuration, for example.

When a person desires to use the shower, he or she would manually manipulate curtain 22 into its desired outward shape (i.e., by using his or her hands), thereby, forming a shape that limits or prevents the intrusion of curtain 22 into the designated area, such as a shower enclosure, and significantly increasing the amount of usable space within the designated area. It should be appreciated that in this embodiment of the present disclosure, curtain 22 provides additional space 37 to the user inside bathtub shower area 35 (e.g., especially in the area that typically would correspond to a user's shoulders, torso and hips).

Figure 3:
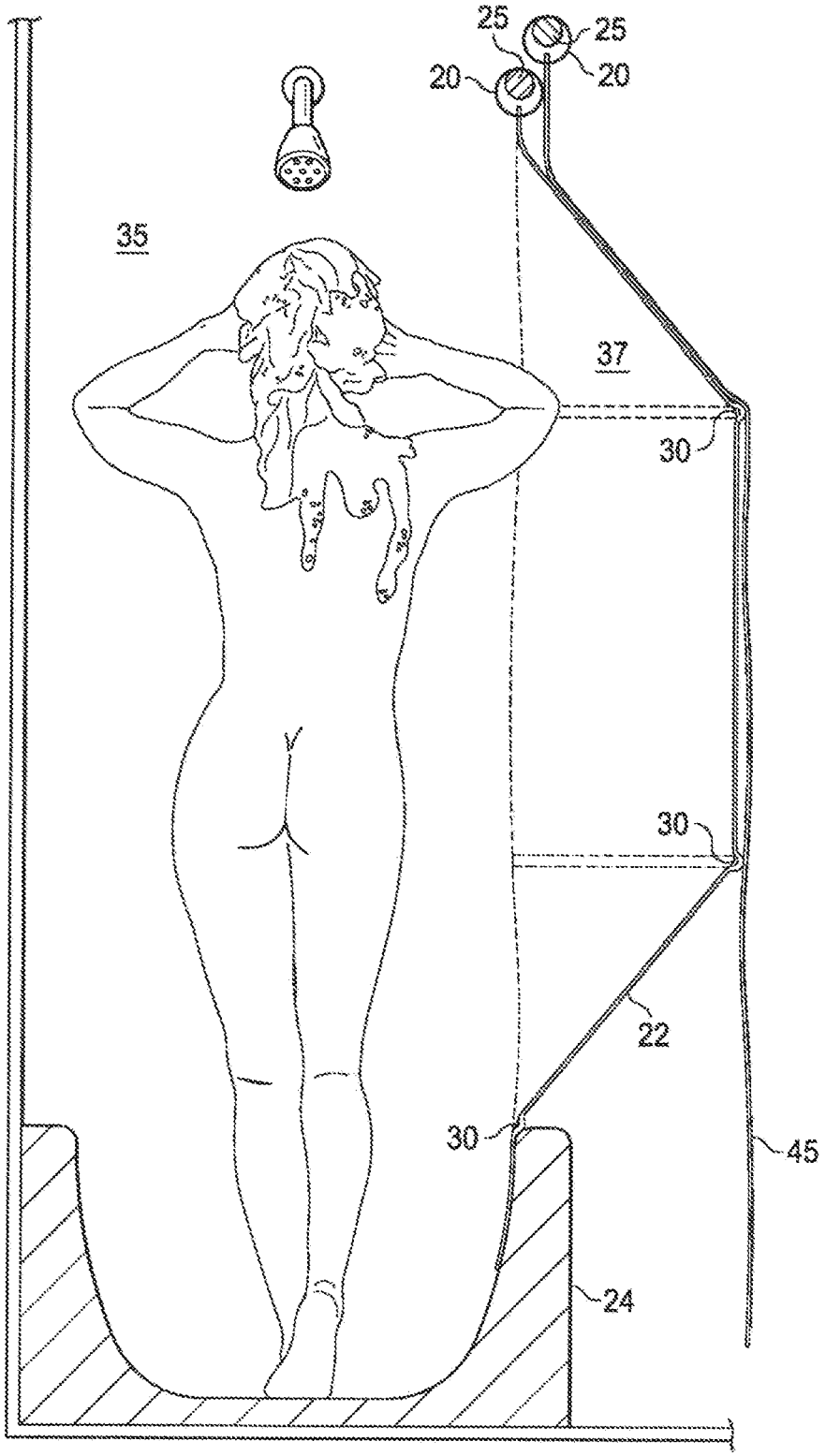
FIG. 3 depicts a side view of an expanding curtain according to an embodiment of the present disclosure.

FIG. 3 depicts a side view of the expanding curtain according to an embodiment of the present disclosure. Curtain 22 is shown in standard bathtub 24/shower enclosure 35 exemplar. Curtain 22 is depicted as being mounted on straight shower rod 25 utilizing a plurality of standard shower curtain rings 20. Curtain 22 is shown in FIG. 3 with three (3) integrated, horizontal hinge/pivot joints 30. In this embodiment of the present disclosure, curtain 22 provides additional space 37 to the user inside bathtub shower area 35 (e.g., especially in the area that typically would correspond to a user's shoulders, torso and hips). Also, curtain 22 in FIG. 3 is illustrated as being used as a waterproof shower liner, with an additional, separate exterior (non-curtain) drape/curtain 45 attached to the same (or a second) rod 25 (i.e., for decorative, etc. purposes).

Figure 4:
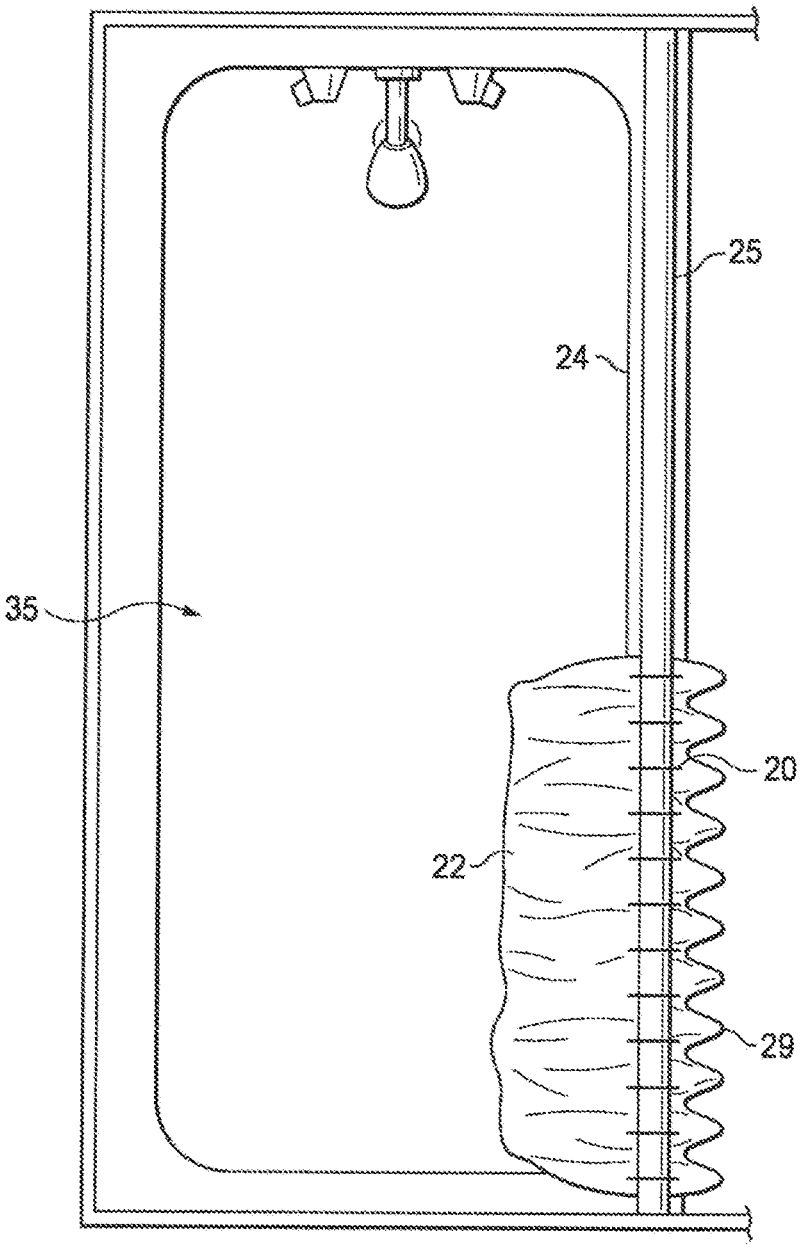
FIG. 4 depicts a top view of an expanding curtain according to an embodiment of the present disclosure.
Figure 5:
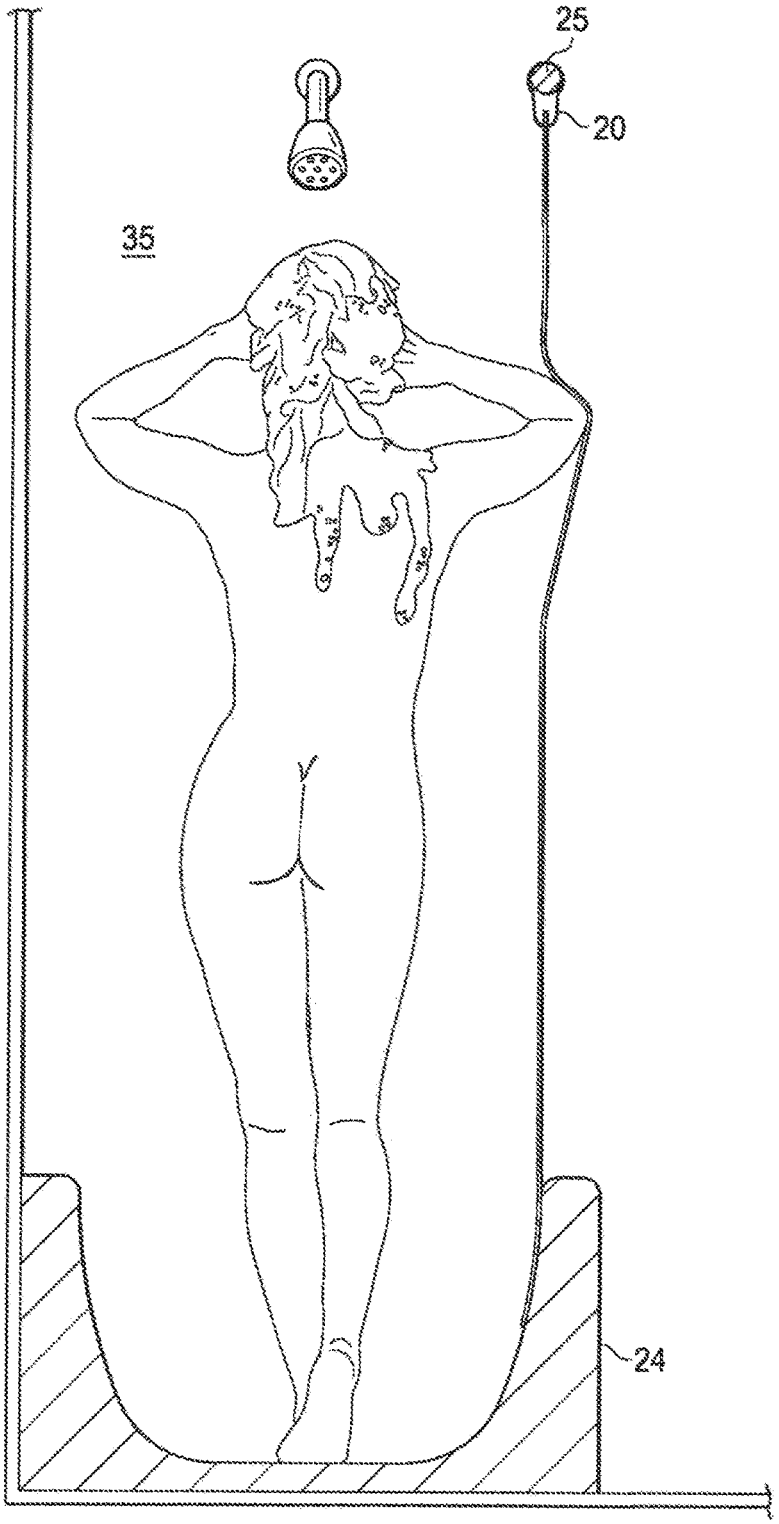
FIG. 5 (PRIOR ART)
FIG. 5 depicts a side view of a standard shower curtain.
Figure 6:
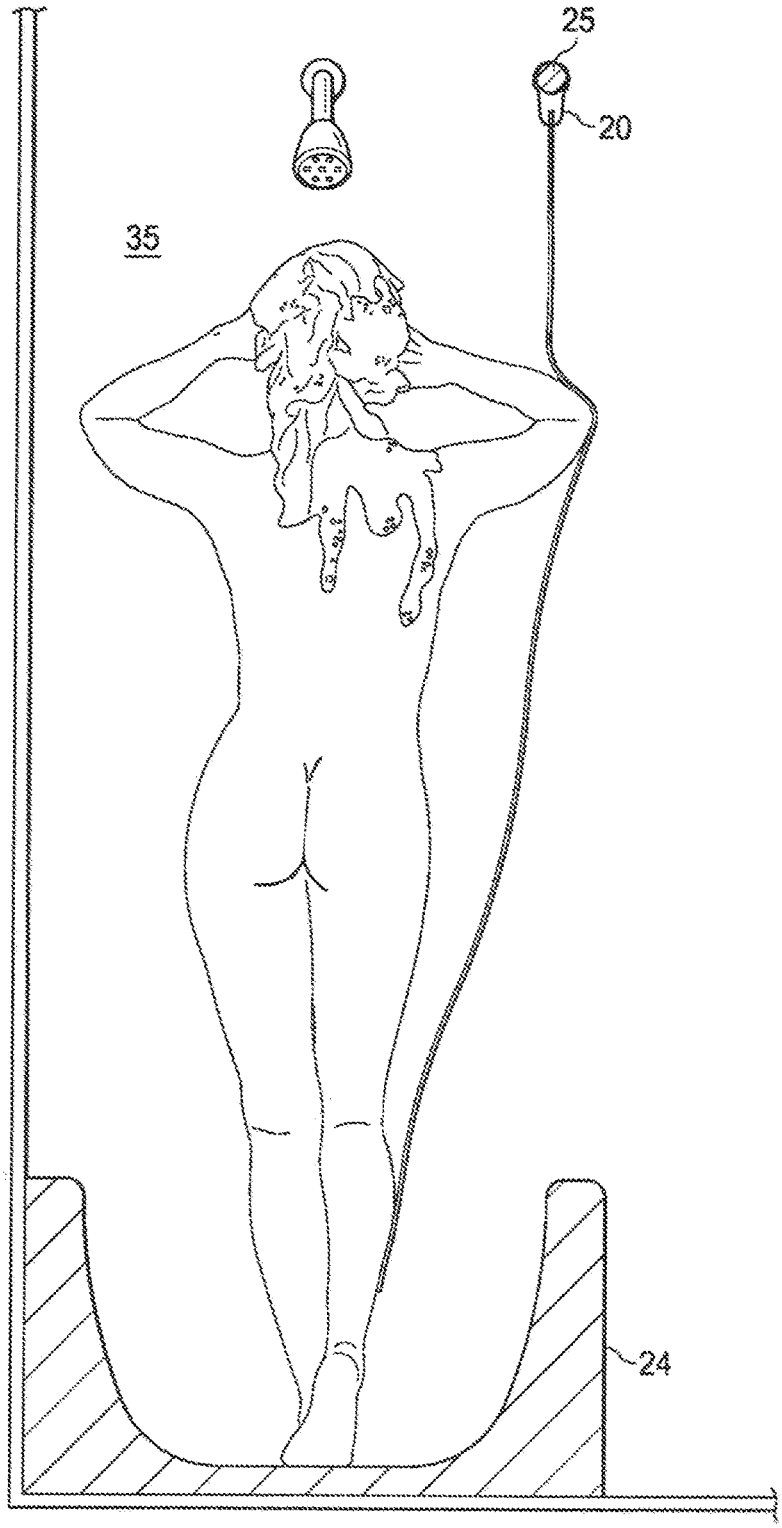
FIG. 6 (PRIOR ART)
FIG. 6 depicts a side view of a standard shower curtain.

FIG. 4 depicts a top view of the expanding curtain according to an embodiment of the present disclosure. In this embodiment of the present disclosure, curtain 22 has been manipulated in to a position whereby the entirety of curtain 22 has been pushed back in to bathtub shower area 35 (i.e., the position that curtain 22 might take when bathtub shower area 35 is not being used), in accordance with the user's preferences. In this position, curtain 22 takes up minimal, if any, space in the washroom outside of the shower area itself. Moreover, curtain 22 is depicted as having been manually manipulated/slid along rod 25 to the side of bathtub shower area 35, so that curtain 22 is compressed together in an "accordion-like" shape 29. This feature allows for easy entrance and exit from bathtub shower area 35. Another alternative for opening (and the maintenance of curtain 22 in an open position) would be to open and hold curtain 22 in place in a "Roman-shade" fashion. In other embodiments of the present disclosure, curtain 22 could have one or more integrated (or non-integrated), vertical hinge/pivot joints (similar to the horizontal hinge/pivot joints described above).

Figure 7:
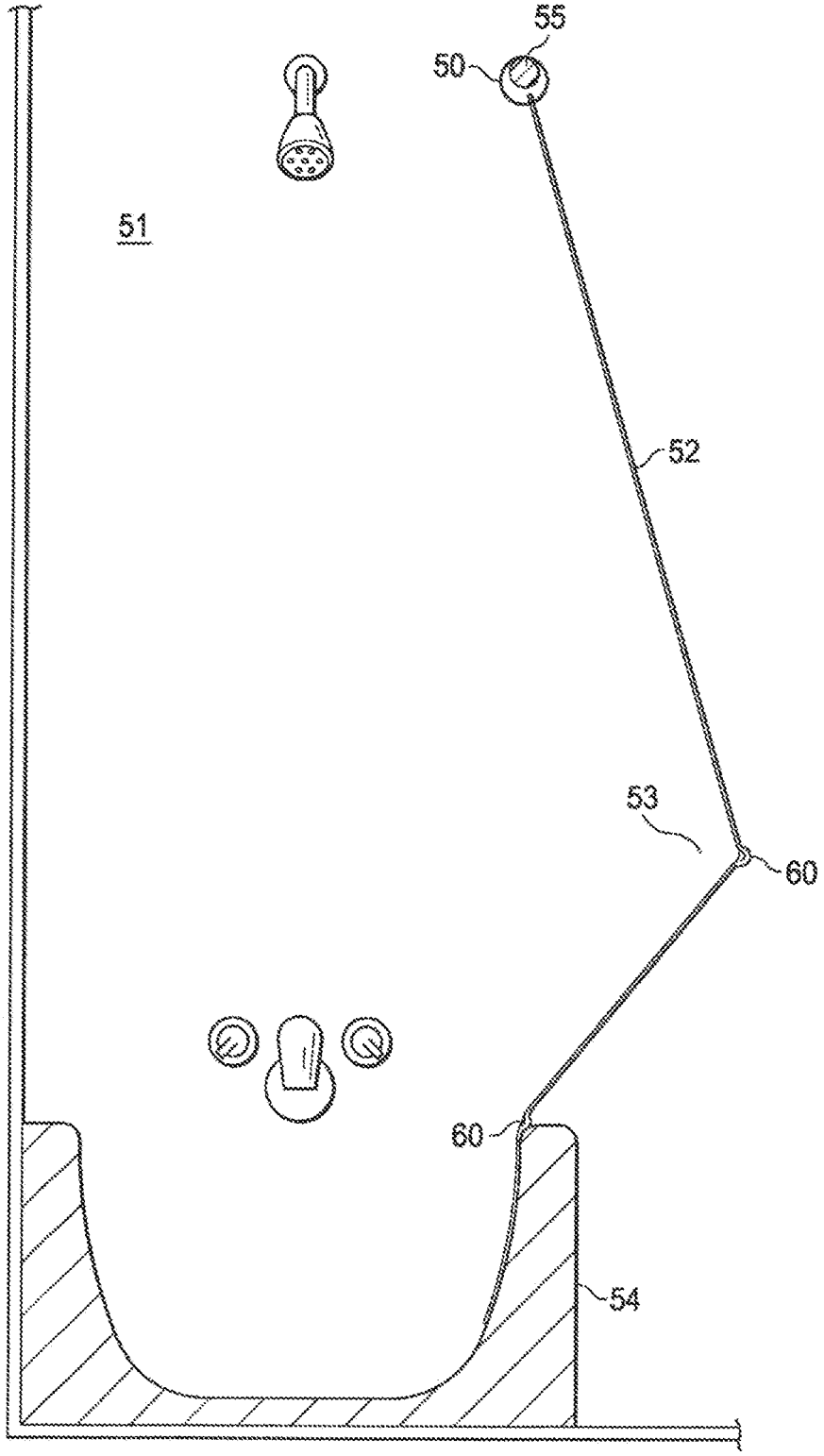
FIG. 7 depicts a side view of an expanding curtain according to another embodiment of the present disclosure.

FIG. 7 depicts a side view of the expanding curtain according to another embodiment of the present disclosure.

Curtain 52 is shown in a standard bathtub 54/shower enclosure 51 exemplar although it may be utilized in other situations without departing from the present disclosure. Curtain 52 is depicted as being mounted on straight shower rod 55 utilizing a plurality of standard shower curtain rings 50. Curtain 52 is shown in FIG. 7 with two (2) integrated, horizontal hinge/pivot joints 60. However, an alternative embodiment of curtain 52 might have more or fewer horizontal hinge/pivot joints 60 or it might not have any defined, integrated, horizontal hinge/pivot joints 60 at all depending on the requirements of a specific application. When a person desires to use shower area 51, he or she would manually manipulate curtain 52 into its desired shape (i.e., by using his or her hands), thereby forming a shape that limits or prevents the intrusion of curtain 52 into the shower enclosure 51 and significantly increases the amount of usable space 53 within shower enclosure 51.

Figure 8:
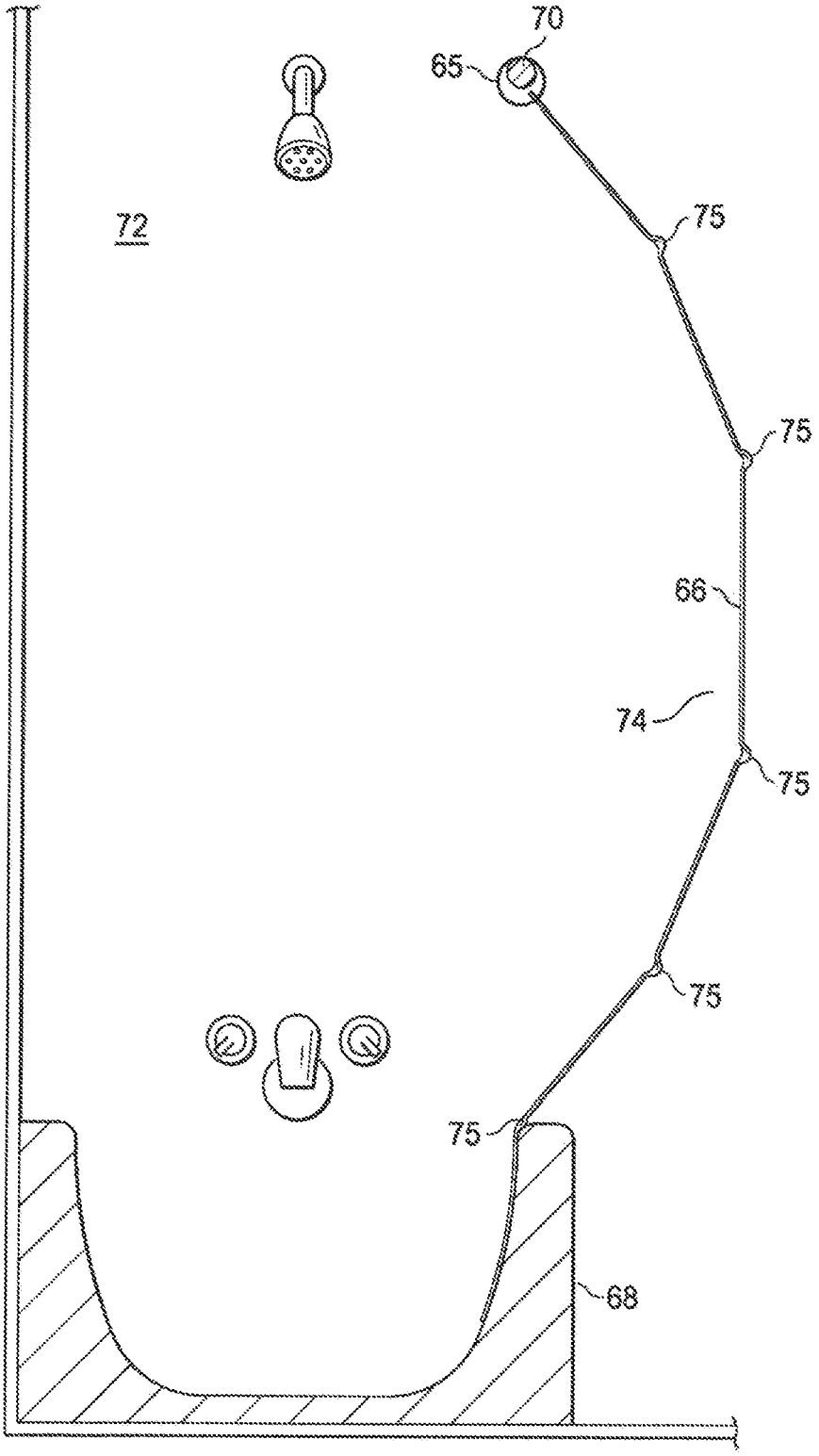
FIG. 8 depicts a side view of an expanding curtain according to another embodiment of the present disclosure.

FIG. 8 depicts a side view of the expanding curtain according to another embodiment of the present disclosure. Curtain 66 is shown in a standard bathtub 68/shower enclosure 72 exemplar although it may be utilized in other situations according to embodiments of the present disclosure. Curtain 66 is depicted as being mounted on straight shower rod 70 utilizing a plurality of standard shower curtain rings 65. Curtain 66 is shown in FIG. 8 with five (5) integrated, horizontal hinge/pivot joints 75. However, an alternative embodiment of curtain 66 might have more or fewer horizontal hinge/pivot joints 75 or it might not have any defined, integrated, horizontal hinge/pivot joints 75 at all depending on the requirements of a specific application. When a person desires to use bathtub shower area 72, he or she would manually manipulate curtain 66 into its desired shape (i.e., by using his or her hands), thereby, forming a shape that limits or prevents the intrusion of curtain 66 into bathtub shower area 72 and significantly increases the amount of usable space 74 within bathtub shower area 72.

Figure 9:
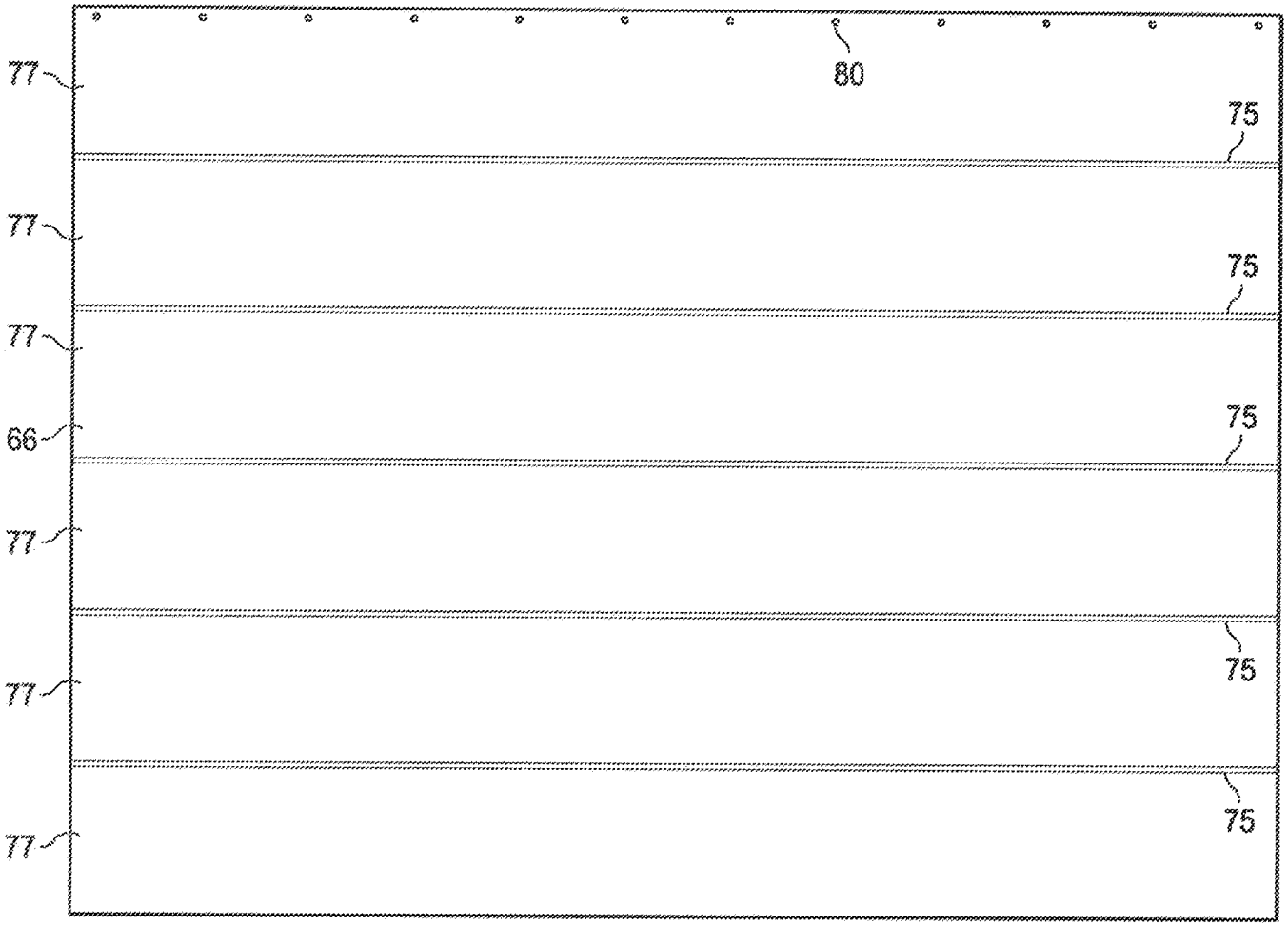
FIG. 9 depicts a front view of an expanding curtain according to another embodiment of the present disclosure.

FIG. 9 depicts a front view of the expanding curtain according to another embodiment of the present disclosure. The alternative embodiment of curtain 66, as illustrated in FIG. 9 (which is a different view of the alternative embodiment illustrated in FIG. 8), evidences curtain 66 as being made from one or more sheets of material, which may be flexible, semi-flexible, rigid, semi-rigid or combinations thereof. Curtain 66 is generally rectangular in shape; however, it may assume other shapes without departing from the present disclosure. Curtain 66 could be constructed of one or more materials including, but not limited to, polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof.

Curtain 66 is depicted in FIG. 9 as having a series of holes 80 in the top section, in order to provide for one manner of mounting curtain 66 (i.e., on a straight shower rod utilizing a plurality of standard shower curtain rings). In other embodiments of the present disclosure, curtain 66 could be altered to be capable of being mounted in a shower enclosure in any other manner in which curtains or liners are typically mounted in such circumstances.

Curtain 66 in FIG. 9 is shown with five (5) integrated, horizontal hinge/pivot joints 75, which divide curtain 66 into multiple panels 77. Hinge/pivot joints 75 could be formed by one or more methods including, but not limited to, welding, stitching, using adhesive, and/or applying pressure and/or heat all along horizontal hinge/pivot joints 75 (i.e., to form a "creased" effect), increasing the thickness of the material in such area, and/or any other method by which the desired result is obtained. Alternatively, multiple panels 77 that comprise curtain 66 could be manufactured separately of one or more types of flexible, semi-flexible, rigid and/or semi-rigid material (e.g., polyester, nylon, plastic, vinyl, silica, plastic-covered cloth, fabric, canvas, all-cotton, linen, ethylene-vinyl acetate (EVA), polyethylene-vinyl-acetate (PEVA), waterproof synthetic material, waterproof natural material, and combinations thereof) and joined together by welding, adhesive, stitching, or similar connection method (thereby forming the desired horizontal hinge/pivot joint).

Flexible, horizontal hinge/pivot joints 75 allow integrated (or discrete) panels 77 of curtain 66 to form and hold various shapes, sizes and/or dimensions, by each maintaining curtain panels 77 in a desired angled outward position when the shower area is in use/occupied by a user. However, in another embodiment of the present disclosure, curtain 66 might have more or fewer horizontal hinge/pivot joints 75 or it might not have any defined, integrated, horizontal hinge/pivot joints 75 at all depending on the requirements of a specific application.

Figure 10:
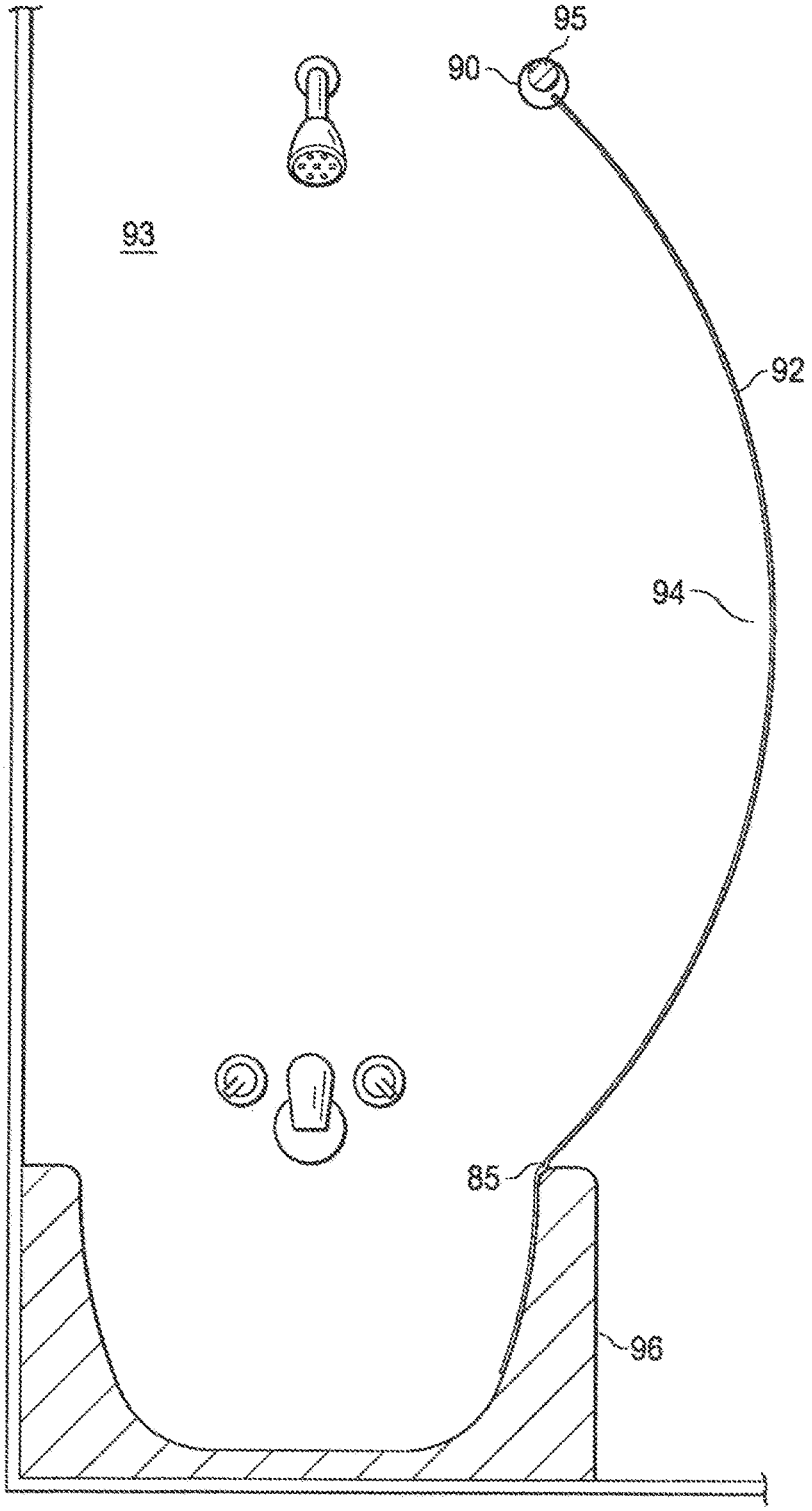
FIG. 10 depicts a side view of an expanding curtain according to another embodiment of the present disclosure.

FIG. 10 depicts a side view of the expanding curtain according to another embodiment of the present disclosure. Curtain 92 is shown in standard bathtub 96/shower enclosure 93 exemplar. Curtain 92 is depicted as being mounted on straight shower rod 95 utilizing a plurality of standard shower curtain rings 90. Curtain 92 is shown in FIG. 10 with one (1) integrated, horizontal hinge/pivot joint 85. However, in other embodiments of the present disclosure, curtain 92 might have more or fewer horizontal hinge/pivot joints 85 or it might not have any defined, integrated, horizontal hinge/pivot joints 85 at all depending on the requirements of a specific application. When a person desires to use bathtub shower area 93, he or she would manually manipulate curtain 92 in to its desired shape (i.e., by using his or her hands), thereby forming a shape that limits or prevents the intrusion of curtain 92 into the shower enclosure and significantly increase the amount of usable space 94 within bathtub shower area 93.

While embodiments of the present disclosure have been described as including horizontal and/or vertical hinge/pivot joints, it should be appreciated that other types of hinge/pivot joints may be utilized without departing from the present disclosure. For example, diagonal hinge/pivot joints may be employed along with or in place of other types of hinge/pivot joints. Further, there may be embodiments of the present disclosure where the flat curtain may include magnets or other weighted materials in order to further secure the flat curtain in place.

Other embodiments of the present disclosure may incorporate an additional sheet of material affixed or attached to a bottom portion of the flat curtain. This additional sheet of material may form a flap that drapes over the lip of a bathtub, for example, falling on the outside of the bathtub to keep the curtain from intruding into the designated area. In some embodiments of the present disclosure, this flap may not be an additional sheet of material; rather, it may be an extension of the sheet of material forming the flat curtain. This flap may be integral with the flat curtain in certain embodiments of the present disclosure.

In summary, a new and unique curtain is presented that effectively reduces and/or eliminates the inward intrusion of a shower curtain during shower use (and its attendant propensity to touch and/or cling to the user), significantly increasing the usable space within a shower area, and the curtain does not take up valuable space in the washroom when not in use but remains simple to open and close, as well as inexpensive to manufacture.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An expanding curtain comprising:

a flat curtain formed of at least one sheet of material and having an expandable center portion, wherein the flat curtain and the center portion are comprised of at least one single panel, and wherein the center portion is configured to be manually manipulated in an outward direction to expand the amount of usable space in a designated area without the use of a mechanical device external to the expanding curtain.

2. The expanding curtain of claim 1, wherein the at least one sheet of material is selected from the group comprising:

a flexible material, a semi-flexible material, a semi-rigid material, a rigid material, and combinations thereof.

3. The expanding curtain of claim 1, wherein the at least one sheet of material is selected from the group comprising:

polyester, nylon, plastic, vinyl, silica, plastic-covered cloth, fabric, canvas, cotton, linen, ethylene-vinyl acetate (EVA), polyethylene-vinyl-acetate (PEVA), synthetic material, waterproof synthetic material, natural material, waterproof natural material, and combinations thereof.

4. The expanding curtain of claim 1, wherein the at least one single panel is integrally formed from the at least one sheet of material.

5. The expanding curtain of claim 1, wherein the at least one single panel is not integrally formed from the at least one sheet of material.

6. The expanding curtain of claim 1, wherein the at least one single panel is partially integrally formed from the at least one sheet of material.

7. The expanding curtain of claim 1, wherein the at least one sheet of material forming all or a distinct part of the center portion is the same material as the remainder of the flat curtain.

8. The expanding curtain of claim 1, wherein the at least one sheet of material forming the center portion is a different material from the remainder of the flat curtain.

9. The expanding curtain of claim 1 further comprising:

a plurality of holes in a top section of the expanding curtain, the plurality of holes used to mount the expanding curtain on a curtain rod, wherein the expanding curtain slides along the curtain rod and compresses into an accordion-like shape to allow entry and exit from the designated area.

10. The expanding curtain of claim 1, wherein the at least one sheet of material is waterproof.

11. The expanding curtain of claim 1, wherein the center portion is waterproof.

12. The expanding curtain of claim 1, wherein the designated area is a bathtub, a shower stall, or an examination or work area.

13. The expanding curtain of claim 12, wherein the width of the expanding curtain at least corresponds to the length of the designated area.

14. The expanding curtain of claim 1 further comprising:

at least one horizontal hinge joint to divide the flat curtain and/or the center portion into more than one panel, wherein the more than one panel is formed or connected in a specific shape so as to angle in an outward position relative to a user occupying the designated area.

15. The expanding curtain of claim 14, wherein the at least one horizontal hinge joint is selected from the group comprising:

a straight line crease, a fold line, a joint where two panels are joined together, and combinations thereof.

16. The expanding curtain of claim 1 further comprising:

at least one vertical hinge joint to divide the flat curtain and/or the center portion into more than one panel, wherein the more than one panel is formed or connected in a specific shape so as to angle in an outward position relative to a user occupying the designated area.

17. The expanding curtain of claim 16, wherein the at least one vertical hinge joint is selected from the group comprising:

a straight line crease, a fold line, a joint where two panels are joined together, and combinations thereof.

18. The expanding curtain of claim 1 further comprising:

at least one diagonal hinge joint to divide the flat curtain and/or the center portion into more than one panel, wherein the more than one panel is formed or connected in a specific shape so as to angle in an outward position relative to a user occupying the designated area.

19. The expanding curtain of claim 16, wherein the at least one diagonal hinge joint is selected from the group comprising:

a straight line crease, a fold line, a joint where two panels are joined together, and combinations thereof.

20. The expanding curtain of claim 1, wherein the flat curtain and/or the center portion includes a plurality of panels formed or connected by joining two or more panels using one or more bonding techniques selected from the group comprising: adhesive, heat, pressure, welding, stitching, and combinations thereof.

* * * * *